US008387902B2

(12) United States Patent
Gotou

(10) Patent No.: US 8,387,902 B2
(45) Date of Patent: Mar. 5, 2013

(54) RECYCLING METHOD AND RECYCLING APPARATUS OF SLURRY FOR USE IN WAFER POLISHING

(75) Inventor: Isamu Gotou, Tokyo (JP)

(73) Assignee: Sumco Corporation, Tokyo (JP)

( * ) Notice: Subject to any disclaimer, the term of this patent is extended or adjusted under 35 U.S.C. 154(b) by 275 days.

(21) Appl. No.: 12/829,597

(22) Filed: Jul. 2, 2010

(65) Prior Publication Data

US 2010/0270403 A1 Oct. 28, 2010

(30) Foreign Application Priority Data

Jul. 3, 2009 (JP) ..... 2009-158883

(51) Int. Cl.
*B02C 19/18* (2006.01)

(52) U.S. Cl. ..... 241/1; 241/21

(58) Field of Classification Search ..... 241/1, 21, 241/301
See application file for complete search history.

(56) References Cited

U.S. PATENT DOCUMENTS 5,791,970 A * 8/1998 Yueh ..... 451/8

FOREIGN PATENT DOCUMENTS

| | | |
|---|---|---|
| JP | 2002-170793 | 6/2002 |
| JP | 2002-331456 | 11/2002 |
| JP | 2004-63858 | 2/2004 |
| JP | 2004-75859 | 3/2004 |
| JP | 2009-54629 | 3/2009 |

* cited by examiner

*Primary Examiner* — Mark Rosenbaum
(74) *Attorney, Agent, or Firm* — Clark & Brody

(57) ABSTRACT

A recycling method of slurry for use in wafer polishing for reusing slurry used in a polishing process of semiconductor wafer, comprises the steps of: adding a dispersant to a recovered used-slurry to inhibit aggregation of the slurry; breaking up aggregates in such a manner that the whole of the used slurry, subjected to the dispersant addition step, is passed through a shearing force imparting device to impart shearing force to the aggregates contained in the slurry by the shearing force imparting device, thereby breaking up the aggregates; and removing foreign substances in the slurry subjected to the aggregate breakup step, by means of a foreign substances removing device. According to the method, a large amount of used-slurry can be processed in a short time.

6 Claims, 6 Drawing Sheets

RECYCLING METHOD AND RECYCLING APPARATUS OF SLURRY FOR USE IN WAFER POLISHING

BACKGROUND OF THE INVENTION

1. Field of the Invention

The present invention relates to a recycling method and a recycling apparatus of slurry which is used in the polishing process of a manufacturing process of semiconductor wafer and, more specifically, a recycling method and a recycling apparatus, which permits the reuse of a large amount of used-slurry in a short time.

2. Description of the Related Art

In the manufacturing process of semiconductor wafer, in general, CMP (Chemical Mechanical Polishing) is used for wafer final polishing. In the CMP, final polishing is performed to make a wafer surface into a mirror surface by pressing an abrasive pad onto the wafer held on a pedestal, supplying slurry as abrasive to between the wafer and the abrasive pad, and rotating the pedestal and the abrasive pad independently.

In the polishing process, the slurry containing colloidal particles (silica, etc.) to which water-soluble polymers such as cellulose are added is generally used for polishing, in order to make the wafer surface into a mirror surface with high flatness.

Since the slurry containing water-soluble polymers is subjected to agitation or pressure in the course of polishing, the water-soluble polymers or colloidal particles clump to generate aggregates. Since the slurry used in the polishing process contains aggregates and there is fear that foreign substances are brought into the slurry, resulting in the contamination of semiconductor wafers, it was not possible to recycle the used-slurry and it is inevitably disposed of as wastes.

In recent years, it has been attempted to recycle used-slurry from the viewpoint of reducing the preparation cost and disposal cost of slurry and protecting the environment. For example, Japanese Patent Application Publication No. 2002-170793 proposes a recycling method of used-slurry, comprising: removing supersize aggregates contained in the used-slurry with a filter, and centrifugally separating and condensing the used-slurry into liquid concentrate of slurry.

Japanese Patent Application Publication No. 2002-331456 proposes a recycling method of used-slurry, comprising: condensing the used-slurry into liquid concentrate of slurry by a membrane separation means, diluting and washing the liquid concentrate of slurry with pure water followed by re-concentrating, and adjusting the pH by adding an alkaline chemical agent.

Further, Japanese Patent Application Publication No. 2004-63858 proposes a method for recycling used-slurry without using a filter by emitting an ultrasonic beam to the used slurry to break up aggregates in the slurry, and then removing the remaining aggregates by sedimentation while adjusting the temperature of the used-slurry.

Japanese Patent Application Publication No. 2004-75859 proposes a recycling method of slurry for use in wafer polishing, comprising: removing metal ions existing in used-slurry, with the aim of preventing contamination of a semiconductor wafer surface, by filtering the used-slurry through chelate forming fibers.

However, any of the methods proposed in these literatures could not entirely solve the following problems, and were inadequate for the reuse of used-slurry.

(1) The composition of slurry changes with the lapse of time since the slurry reacts readily with air (particularly, carbon dioxide).

(2) In case of the filtration by a filter, frequent replacement of the filter is needed since clogging of the filter with aggregates occurs in a short time.

(3) If metal-ion-containing foreign substances are mixed to the slurry in the polishing process, the resulting semiconductor wafer is contaminated therewith, causing product defects.

Therefore, Japanese Patent Application Publication No. 2009-54629 proposes a recycling method of slurry for use in wafer polishing, comprising: adding a dispersant for inhibiting the aggregation of slurry to the recovered used-slurry; emitting an ultrasonic beam toward the resulting slurry to break up aggregates in the slurry; further adding a chelating agent to the used-slurry to remove metal ions; and thereafter removing foreign substances in the slurry with a filter. Thus, it is perceived that according to the method for recycling slurry for use in wafer polishing of this literature, all the above-mentioned problems (1) to (3) can be solved.

SUMMARY OF THE INVENTION

In the recycling method of slurry for use in wafer polishing proposed by Japanese Patent Application Publication No. 2009-54629, an ultrasonic oscillator is set in a storage tank for storing used-slurry, and the used-slurry is exposed to an ultrasonic beam to cause the aggregates in the used slurry to break up. However, the region in which the ultrasonic oscillator can emit the ultrasound to effect is limited to the peripheral area surrounding the ultrasonic oscillator. Therefore, the ultrasound acts on only a part of the slurry with most of the slurry being left without being subject to the effect of ultrasound, and the aggregates in the slurry cannot be thus effectively broken up. Accordingly, used-slurry must be circulated nearby the ultrasonic oscillator when a large amount of slurry is processed, and a long period of time is required for the recycling process of used-slurry.

If the used-slurry is not effectively exposed to ultrasound in the storage tank and reaches the filter for removing foreign substances in a state where the aggregates are left therein, the filter is clogged therewith. In this case, the filter must be frequently replaced, resulting in an increased operation cost. From these reasons, the processing amount and processing time of slurry to be recycled are issues to be addressed in the recycling method of slurry for use in wafer polishing proposed by Japanese Patent Application Publication No. 2009-54629.

In view of the above-mentioned problems, an object of the present invention is to provide a recycling method and a recycling apparatus of recycling slurry for use in wafer polishing, which permits a large amount of used-slurry to be processed and recycled in a short time.

Means For Solving the Problems

For solving the above problems, the present inventors performed various experiments and repeated earnest reviews thereof. As a result, the present inventors found that aggregates in used-slurry can be effectively broken up by passing the whole of the used-slurry through a shearing force imparting device to impart shearing force to the aggregates by the shearing force imparting device, and a large amount of used-slurry can be thus processed and recycled in a short time.

The present invention has been accomplished based on the above-mentioned finding, and includes a recycling method of slurry for use in wafer polishing according to the following (1) to (3), and a recycling apparatus of slurry for use in wafer polishing according to the following (4) to (6) as the summary of the present invention.

(1) A recycling method of slurry for use in wafer polishing for reusing the used-slurry in a polishing process of semiconductor wafer, comprises the steps of: adding a dispersant to a recovered used-slurry to inhibit aggregation of the slurry; breaking up aggregates in such a manner that the whole of the used-slurry, subjected to the dispersant addition step, is passed through a shearing force imparting device to impart shearing force to aggregates contained in the slurry by the shearing force imparting device, thereby breaking up the aggregates; and removing foreign substances in the slurry subjected to the aggregate breakup step, by means of a foreign substances removing device.

(2) In the recycling method of slurry for use in wafer polishing according to (1), a micro-bubble generator can be used as the shearing force imparting device in the aggregate breakup step. In this case, a cyclone micro-bubble generator, a horn micro-bubble generator or an extrusion micro-bubble generator can be adopted for the micro-bubble generator.

(3) In the recycling method of slurry for use in wafer polishing according to (1) or (2), unused slurry can be used as dispersant in the dispersant addition step.

(4) A recycling apparatus of slurry for use in wafer polishing for reusing slurry used in a polishing process of semiconductor wafer, comprises: a dispersant addition device for adding a dispersant to the recovered used-slurry; a shearing force imparting device for passing the whole of the slurry containing the dispersant there through to impart shearing force to aggregates contained in the slurry to thereby break up the aggregates; and a foreign substances removing device for removing foreign substances in the slurry passed through the shearing force imparting device.

(5) In the recycling apparatus of slurry for use in wafer polishing according to (4), a micro-bubble generator can be employed as the shearing force imparting device. In this case, a cyclone micro-bubble generator, a horn micro-bubble generator or an extrusion micro-bubble generator can be adopted for the micro-bubble generator.

(6) In the recycling apparatus of slurry for use in wafer polishing according to (4) or (5), unused slurry can be employed as dispersant.

According to the recycling method of slurry for use in wafer polishing of the present invention, aggregates can be broken up by passing the whole of used-slurry through the shearing force imparting device, and a large amount of used-slurry can be thus processed and recycled in a short time.

According to the recycling apparatus of slurry for use in wafer polishing of the present invention, further, used-slurry can be stably processed and recycled since clogging of a filter with the aggregates left in the used-slurry can be prevented.

DETAILED DESCRIPTION OF THE PREFERRED EMBODIMENTS

In reference to a configuration example of a recycling apparatus of slurry for use in wafer polishing according to the present invention, a recycling method using the apparatus will be described based on the drawings.

Figure 1:
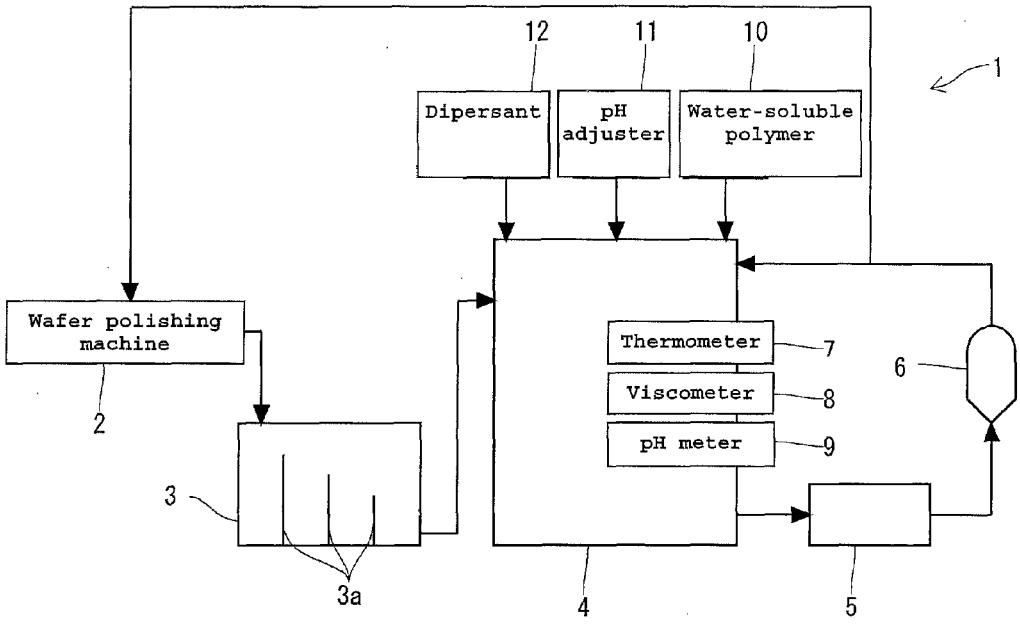
FIG. 1 is a diagram showing a configuration example of a recycling apparatus of slurry for use in wafer polishing according to the present invention.

FIG. 1 is a diagram showing one configuration example of the recycling apparatus of slurry for use in wafer polishing according to the present invention. A recycling apparatus 1 comprises: a multistage cascade tank 3 for recovering slurry used in a wafer polishing machine 2; a storage tank 4 for storing the used-slurry passed through the multistage cascade tank 3; a shearing force imparting device 5 for breaking up aggregates contained in the used-slurry passed through the storage tank 4 by imparting shearing force to the aggregates; and a foreign substances removing device 6 for removing foreign substances contained in the used-slurry passed through the shearing force imparting device 5. The multistage cascade tank 3, the storage tank 4, the shearing force imparting device 5 and the foreign substances removing device 6 are connected in order by piping so that the used-slurry passed through the foreign substances removing device 6 is re-supplied to the wafer polishing machine 2.

The multistage cascade tank 3 comprises a plurality of baths partitioned by a plurality of flashboards 3*a* differed in height. In the multistage cascade tank 3, sedimentation removal of large aggregates is repeated through the plurality of baths, and the supernatant of the used-slurry is supplied to the storage tank 4.

The storage tank 4 comprises a thermometer 7 for measuring a temperature of used-slurry stored therein (hereinafter referred to also as "stored slurry"); a viscometer 8 for measuring viscosity of the stored slurry; and a pH meter 9 for measuring pH of the stored slurry. The storage tank 4 further includes a water-soluble polymer addition device 10 for adjusting the viscosity of the stored slurry by adding a water-soluble polymer thereto; a pH adjuster addition device 11 for adjusting the pH of the stored slurry by adding a pH adjuster thereto; and a dispersant addition device 12 for inhibiting aggregation of used-slurry by adding a dispersant to the stored slurry. The storage tank 4 also includes a cooling device, not shown, for adjusting the temperature of the stored slurry.

The shearing force imparting device 5 breaks up aggregates contained in the used-slurry passing there through into fine aggregate particles by imparting shearing force to the aggregates. The shearing force imparting device 5 is disposed along the path between the storage tank 4 and the foreign substances removing device 6, whereby the whole of aggregates of the used-slurry can be passed through the shearing force imparting device 5 to be broken up, without entailing large-scale remodeling of the apparatus.

The foreign substances removing device 6 removes foreign substances contained in the used-slurry in which aggregates are broken up by the shearing force imparting device 5.

The shearing force imparting device, the dispersant and the foreign substances removing device that characterize the present invention will be then described in detail.

(A) Shearing Force Imparting Device

In the present invention, the shearing force imparting device means a device configured to break up aggregates contained in used-slurry passing there through into fine aggregate particles by imparting shearing force to the aggregates. As the shearing force imparting device of the present invention, for example, an ultrasonic oscillator which emits ultrasound to the passing used-slurry to thereby impart the shearing force to the used-slurry by cavitation can be employed. As the shearing force imparting device, a micro-bubble generator can be also employed.

The micro-bubble generator is generally configured to generate very fine bubbles (micro-bubbles) in liquid by supplying gas and liquid thereto independently or in a form of mixture. However, in the present invention, it is only necessary to supply the used slurry to the micro-bubble generator, and generation of micro-bubbles in the used-slurry is not needed.

The used-slurry is subjected to compression by the micro-bubble generator while passing through the micro-bubble generator, and then suddenly to expansion. During the occasion, the shearing force is imparted to the used-slurry, and the aggregates in the used-slurry are broken up to fine aggregate particles.

Concrete examples of the micro-bubble generator include a cyclone micro-bubble generator, a horn micro-bubble generator, and an extrusion micro-bubble generator. In the present invention, any of the above-mentioned micro-bubble generators can be adopted for the shearing force imparting device.

Figure 2:
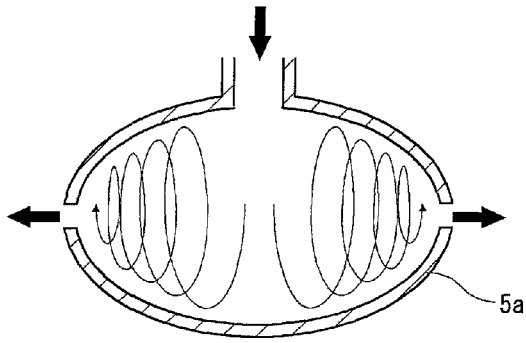
FIG. 2 is a diagram showing a cyclone micro-bubble generator as a specific example of a micro-bubble generator adoptable for a shearing force imparting device.

FIG. 2 is a diagram showing a cyclone micro-bubble generator as one concrete example of the micro-bubble generator adoptable for the shearing force imparting device. As shown by solid arrows in the same figure, used-slurry which flows from an upper part of a cyclone micro-bubble generator 5*a* into a main container is discharged through discharge ports provided on both side walls of the main container. Since the cyclone micro-bubble generator 5*a* has a flow path becoming narrower in a direction toward the discharge ports, the passing used-slurry is subjected to compression while whirling (refer to spiral arrows in the same figure), and to expansion just after it is discharged out of the discharge ports. The shearing force is imparted to the used-slurry by subjecting to such compression and expansion, and the aggregates are broken up.

Figure 3:
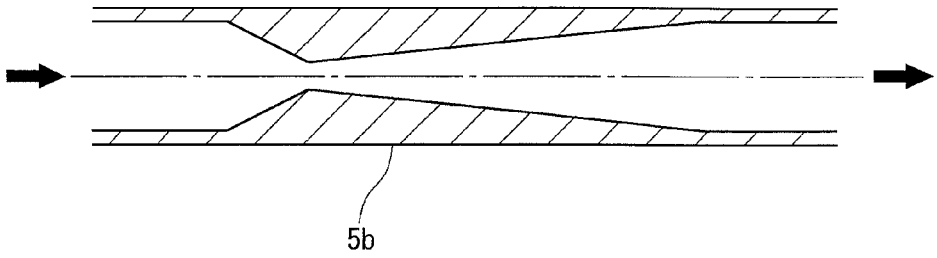
FIG. 3 is a diagram showing a horn micro-bubble generator as another concrete example of the micro-bubble generator adoptable for the shearing force imparting device.

FIG. 3 is a diagram showing a horn micro-bubble generator as another concrete example of the micro-bubble generator adoptable for the shearing force imparting device. As shown in the same figure, a horn micro-bubble generator 5*b* has a flow path for passing used-slurry, which is narrowed midway through. The used-slurry passes the flow path within the horn micro-bubble generator 5*b* in a direction shown by solid arrows. At that time, the used-slurry is subjected to compression as the flow path is narrowed, and then to expansion. The shearing force is imparted to the used-slurry by subjecting to such compression and expansion, and the aggregates are broken up.

Figure 4A:
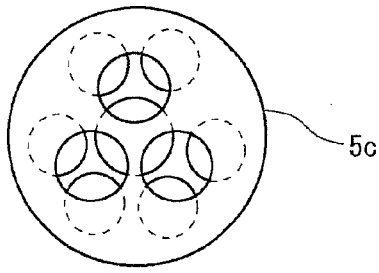
FIGS. 4A and 4B are diagrams showing an extrusion micro-bubble generator as the other concrete example of the micro-bubble generator adoptable for the shearing force imparting device.
Figure 4B:
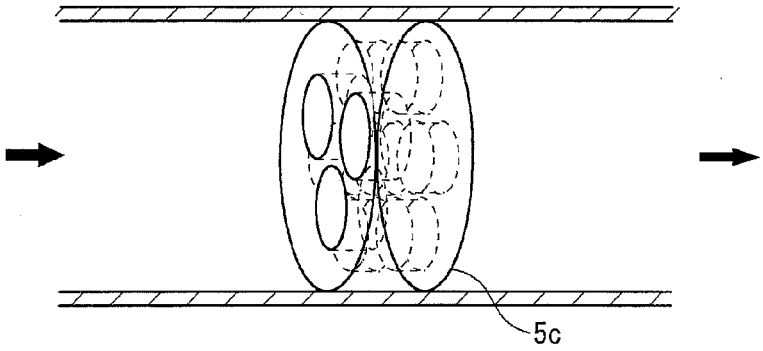

FIGS. 4A and 4B are diagrams showing an extrusion micro-bubble generator as the other concrete example of the micro-bubble generator adoptable for the shearing force imparting device. FIG. 4A is a front view of the generator, and FIG. 4B is a schematic view showing the flowing direction of used-slurry. As shown in FIG. 4A, an extrusion micro-bubble generator 5*c* includes holes extending from the front face to an intermediate point, and also holes extending from the back face to the intermediate point and having each center offset from those of the holes from the front face. Therefore, as shown in FIG. 4B, the used slurry flowing from the front face side is subjected to compression at the intermediate point where the flow path is narrowed, and then to expansion. The shearing force is imparted to the used-slurry by subjecting to such compression and expansion, and the aggregates are broken up.

(B) Dispersant

In the present invention, the dispersant means a material to be added to used-slurry to suppress aggregation of the used-slurry or to prevent generation of aggregates. As the dispersant, any one of (1) salt, (2) polar molecule, (3) pH adjuster, and (4) slurry-constituent-containing chemical solution can be employed. As concrete examples of the dispersant, the followings can be adopted.

(1) As the salt, any salt composed of a combination of a positive ion selected from $Li^+$, $Na^+$, $K^+$, $Mg_2^+$, $Ca_2^+$, and $NH_4^+$ and a negative ion selected from $CO_3^{2-}$, $Cl^-$, $SO_4^{2-}$, $S^{2-}$, $F^-$, $NO_3^-$, $PO_4^{3-}$, $CH_3COO^-$, and $OH^-$ can be adopted.

(2) As the polar molecule, ammonia water and those containing alcohol, sugar, and ether can be adopted.

(3) As the pH adjuster, ammonia water, KOH, and NaOH can be adopted.

(4) As the slurry-constituent-containing chemical solution, the one containing a water-soluble polymer such as ammonia or cellulose and colloidal silica can be adopted. Unused slurry containing them is also adoptable. The unused slurry is preferably employed as the dispersant, since the aggregation of used-slurry can be inhibited without changing the composition of the slurry.

(C) Foreign Substances Removing Device

In the present invention, as the foreign substances removing device, a generally-used foreign substances removing device by means of foreign substances removing method such as floatation or sedimentation separation, filtration, electro-separation or thermal separation can be adopted, since aggregates are broken up by the shearing force imparting device.

In the present invention, filtration, floatation separation, centrifugal separation, or ultra filtration is preferably employed in the foreign substances removing device, but not particularly limited thereto. The filtration and floatation separation can be easily attained, and the centrifugal separation and ultra filtration bring in an improved foreign substances removal rate.

A recycling method of used-slurry using a recycling apparatus having such a configuration will be described in reference to FIGS. 1 and 5.

Figure 5:
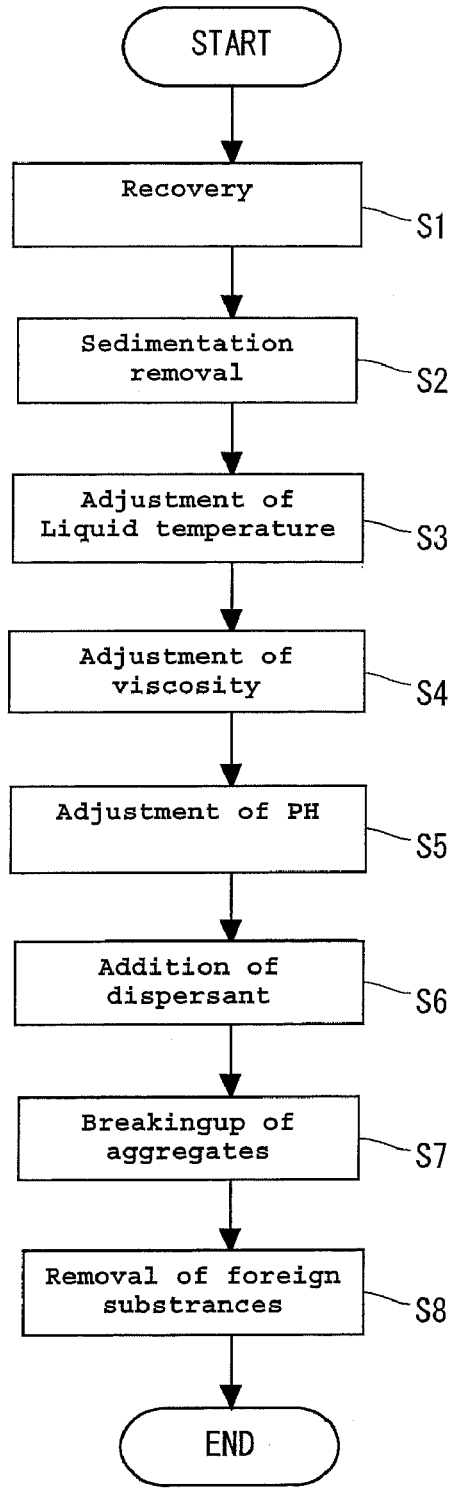
FIG. 5 is a flowchart showing a process example of a recycling method of slurry for use in wafer polishing according to the present invention.

FIG. 5 is a flowchart showing a process example of the recycling method of slurry for use in wafer polishing according to the present invention. S1 to S8 in the same figure show recycling steps.

In recycling of used-slurry, firstly, slurry which is used in the wafer polishing machine 2 is recovered, and supplied to the multistage cascade tank 3 (S1).

The used-slurry supplied to the multistage cascade tank 3 is subjected to sedimentation removal of large aggregates in the slurry (S2), and supplied to the storage tank 4.

The slurry supplied to the storage tank 4 is cooled and adjusted to an appropriate liquid temperature by a cooling device set in the storage tank 4 (S3). For example, the slurry is adjusted in the range of 20 to 30° C. based on the measurement value by the thermometer 7.

After completion of the liquid temperature adjustment, the viscosity of the slurry stored in the storage tank 4 is measured by the viscometer 8, and the water-soluble polymer is added to the slurry, based on this measurement value, by the water-soluble polymer addition device 10 to adjust the viscosity of the slurry (S4).

After completion of the viscosity adjustment, the pH of the slurry stored in the storage tank 4 is measured by the pH meter 9, and the pH adjuster is added to the slurry, based on this measurement value, by the pH adjuster addition device 11 to adjust the pH of the slurry (S5). The pH is adjusted, for example, to be in the range of 9 to 11.

After completion of the pH adjustment, the dispersant is added to the slurry in the storage tank 4 by the dispersant addition device 12 (S6).

After completion of the dispersant addition, the slurry in the storage tank 4 is supplied to and passes through the shearing force imparting device 5, and aggregates contained in the slurry are finely broken up by imparting shearing force to the aggregates (S7).

After completion of breaking up the aggregates, the slurry is passed through the foreign substances removing device 6 to remove foreign substances in the slurry (S8).

Subsequently to the foreign substances removing step, the slurry is supplied to the wafer polishing machine 2 and used for polishing. As occasion demands, the slurry can be circulated among the storage tank 4, the shearing force imparting device 5 and the foreign substances removing device 6 several times prior to the supply to the wafer polishing machine 2.

As explained so far, according to the recycling method and recycling apparatus 1 of slurry for use in wafer polishing of the present invention, aggregates can be broken up by passing the whole of the used-slurry through the shearing force imparting device 5, and a large amount of used-slurry can be processed and recycled in a short time.

EXAMPLES

The following tests were carried out to confirm the effects of the recycling method and recycling apparatus of slurry for use in wafer polishing according to the present invention.

Example 1

(Quality Evaluation Test of Semiconductor Wafer After Polishing)

A semiconductor wafer was polished by use of slurry processed by the recycling method of slurry for use in wafer polishing according to the present invention, and the surface quality of the resulting semiconductor wafer was verified.

As an inventive example, used-slurry was recycled using the recycling apparatus shown in FIG. 1, and the resulting recycled slurry was supplied to a wafer polishing machine to perform polishing of a semiconductor wafer surface. On this occasion, as the slurry to be used in the polishing, an alkali solution of pH 10 containing cellulose that is a polymer dispersant and colloidal silica was used for 500 minutes in the wafer polishing machine, and used-slurry thereof was processed by the recycling device of the present invention, and supplied. In the Inventive Example, a cyclone micro-bubble generator was employed as the shearing force imparting device, and unused slurry was added as dispersant.

As a Comparative example, unused slurry of the same composition as the one used in the Inventive Example was supplied to the wafer polishing machine to perform polishing of a semiconductor wafer surface.

In both the Inventive Example and the Comparative Example, the surface of a semiconductor wafer of 150 mm in diameter was polished as an evaluation specimen. The polishing time was 30 minutes in both the Examples. As quality evaluation items, the number of scratch-like defects (pcs/w) and the number of LPD defects (pcs/w) which were observed on the polished wafer surface, and the polishing rate (μm/min) were examined.

As a result, the number of scratch-like defects was 0.2 pcs/w in the Inventive Example, and 0.4 pcs/w in the Comparative Example. The number of LPD defects was 0.4 pcs/w in both the Inventive Example and the Comparative Example. Further, the polishing rate was 0.027 μm/min in the Inventive Example, and 0.012 μm/min in the Comparative Example. It could be confirmed from these results that the polishing quality in the Inventive Example is equal to that in the Comparative Example.

Example 2

[Test For Breakup of Aggregated Silica By Imparting Shearing Force Using Ultrasound]

The effect for the breakup of aggregated silica by a shearing force imparting device using ultrasound was verified. The slurry used in each of Inventive Example 1 and Comparative Examples 1 to 3 has the same composition as the slurry used in Example 1. In Comparative Example 1, the slurry was used in as-is condition, and in Comparative Examples 2 and 3, the slurry was agitated for 90 minutes and for 180 minutes, respectively, prior to use. In Inventive Example 1, the slurry was repeatedly passed through the shearing force imparting device using ultrasound for 10 minutes. The aggregation degrees of the slurries in Comparative Examples 1 to 3 and Inventive Example 1 were examined.

The aggregation degree was calculated in such a manner that silica particles, observed in the used-slurry, larger in size than that observed in unused slurry are judged as aggregates, and the content ratio of aggregates in the used-slurry is computed from the observed sizes and densities of aggregates.

Figure 6:
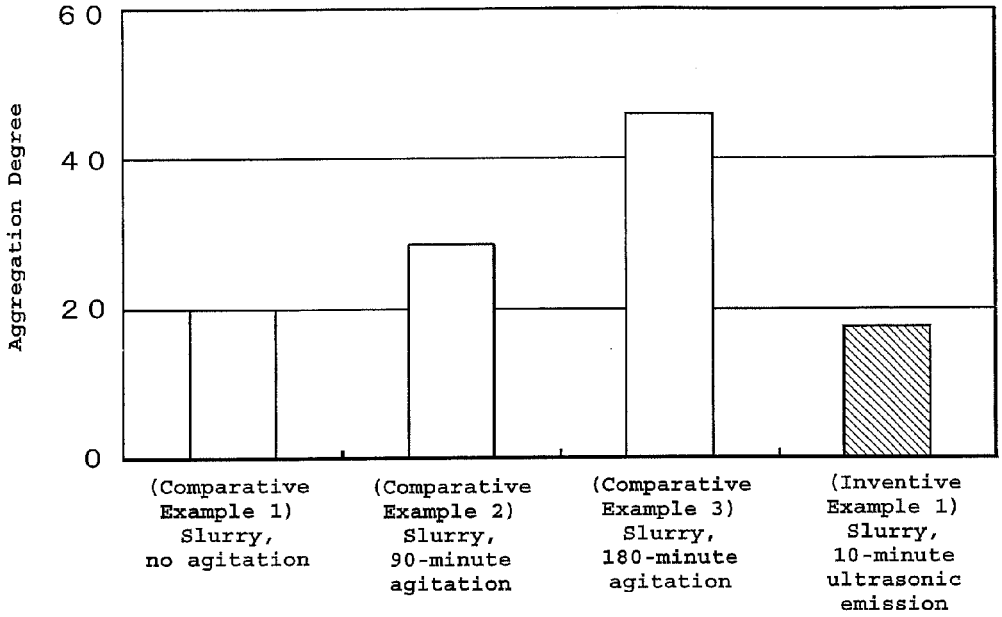
FIG. 6 is a graph showing the aggregates breakup effect of a shearing force imparting device using ultrasound.

FIG. 6 is a graph showing the effect for the breakup of aggregated silica by the shearing force imparting device using ultrasound. As shown in the same figure, it could be confirmed, based on the gradual increase of aggregation degree from Comparative Example 1 to Comparative Example 3, that aggregated silica in slurry is generated by and the aggregation of the slurry is caused by agitation. On the other hand, the aggregation degree in Inventive Example 1 in which the slurry was passed through the shearing force imparting device using ultrasound was lower than that of the slurry in Comparative Example 1. Therefore, it could be confirmed that the shearing force imparting device using ultrasound has the breakup effect for the aggregated silica.

Example 3

[Test For Breakup of Aggregated Silica By Cyclone Micro-Bubble Generator]

The effect for the breakup of aggregated silica by a shearing force imparting device using a cyclone micro-bubble generator was verified. The slurry used as Comparative Example 4 was prepared by adding a mixture, as the dispersant, of water-soluble polymer (cellulose) and silica to the unused slurry used in Example 1, and the slurry used as Comparative Example 5 was prepared by agitating the slurry of Comparative Example 4 for 10 minutes.

The slurry used as Inventive Example 2 was prepared by repetitively passing the slurry of Comparative Example 4 through the shearing force imparting device using the cyclone micro-bubble generator for 10 minutes, and the slurry used as Inventive Example 3 was prepared by repetitively passing the slurry of Comparative Example 4 through the shearing force imparting device using the cyclone micro-bubble generator for 1 hour. The aggregation degrees of the slurries in Comparative Examples 4 and 5 and Inventive Examples 2 and 3 were examined respectively.

Figure 7:
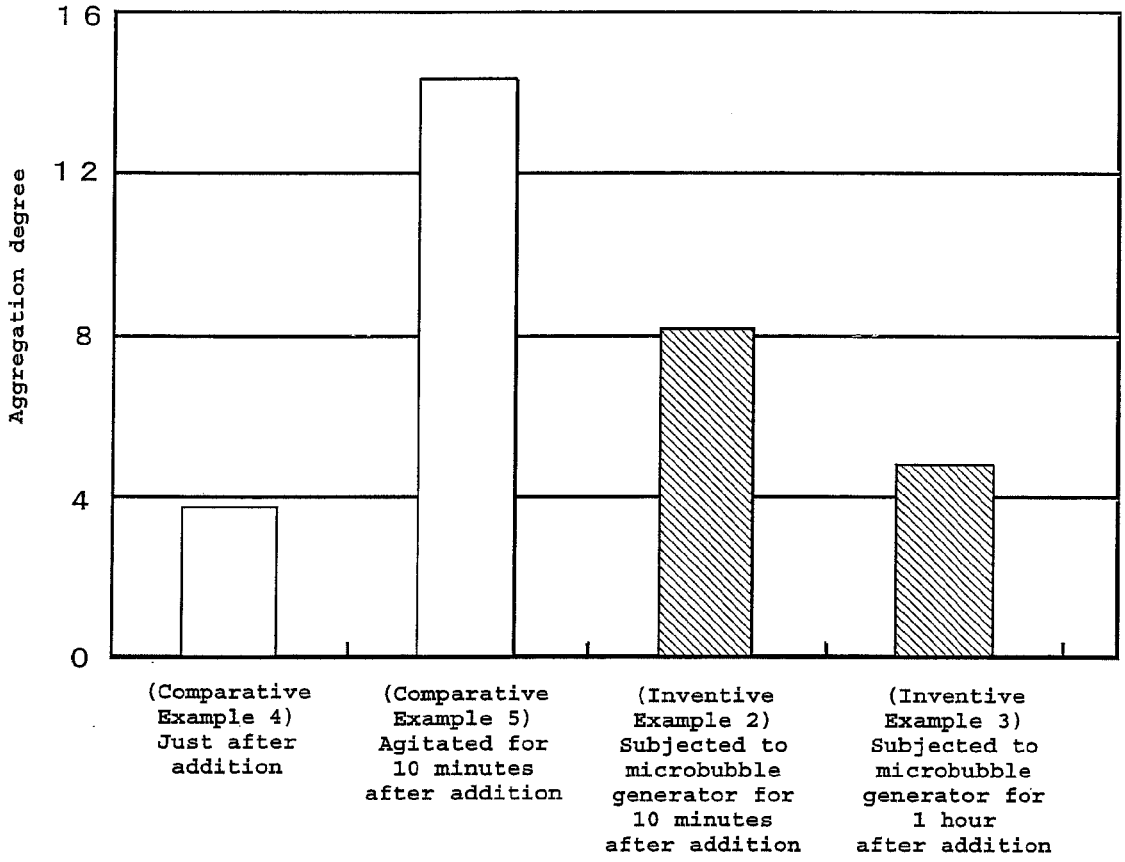
FIG. 7 is a graph showing the aggregates breakup effect of a shearing force imparting device using the cyclone micro-bubble generator.

FIG. 7 is a graph showing the effect for the breakup of aggregated silica by the shearing force imparting device using the cyclone micro-bubble generator. As shown in FIG. 7, it could be confirmed, based on the aggregation degrees of Comparative Examples 4 and 5, that generation of aggregated silica in slurry or aggregation of the slurry is caused by agitation. The aggregation degrees in Inventive Examples 2 and 3 subjected to the cyclone micro-bubble generator were lower than that in Comparative Example 5. Therefore, it could be confirmed that the shearing force imparting device using the cyclone micro-bubble generator has the breakup effect for the aggregated silica.

Example 4

[Test For Dispersion of Aggregated Silica By Slurry-Constituent-Containing Dispersant]

The effect for dispersion of aggregated silica when a slurry-constituent-containing chemical solution was used as the dispersant was verified. As Comparative Examples 6 and 7, final polishing was performed for 500 minutes by use of the unused slurry used in Example 1, and water was then added to the used slurry as the dispersant. As Inventive Examples 4 and 5, a mixture of water-soluble polymer (cellulose) and silica was added as the dispersant instead of the water used in case of Comparative Examples 6 and 7.

With respect to each slurry of Comparative Examples 6 and 7 and Inventive Examples 4 and 5, the aggregation degree was examined: just after addition of the dispersant; after passing the slurry containing the dispersant through the shearing force imparting device using ultrasound for 5 minutes or 10 minutes; and after agitating the slurry containing the dispersant for 10 minutes or 20 minutes.

Figure 8:
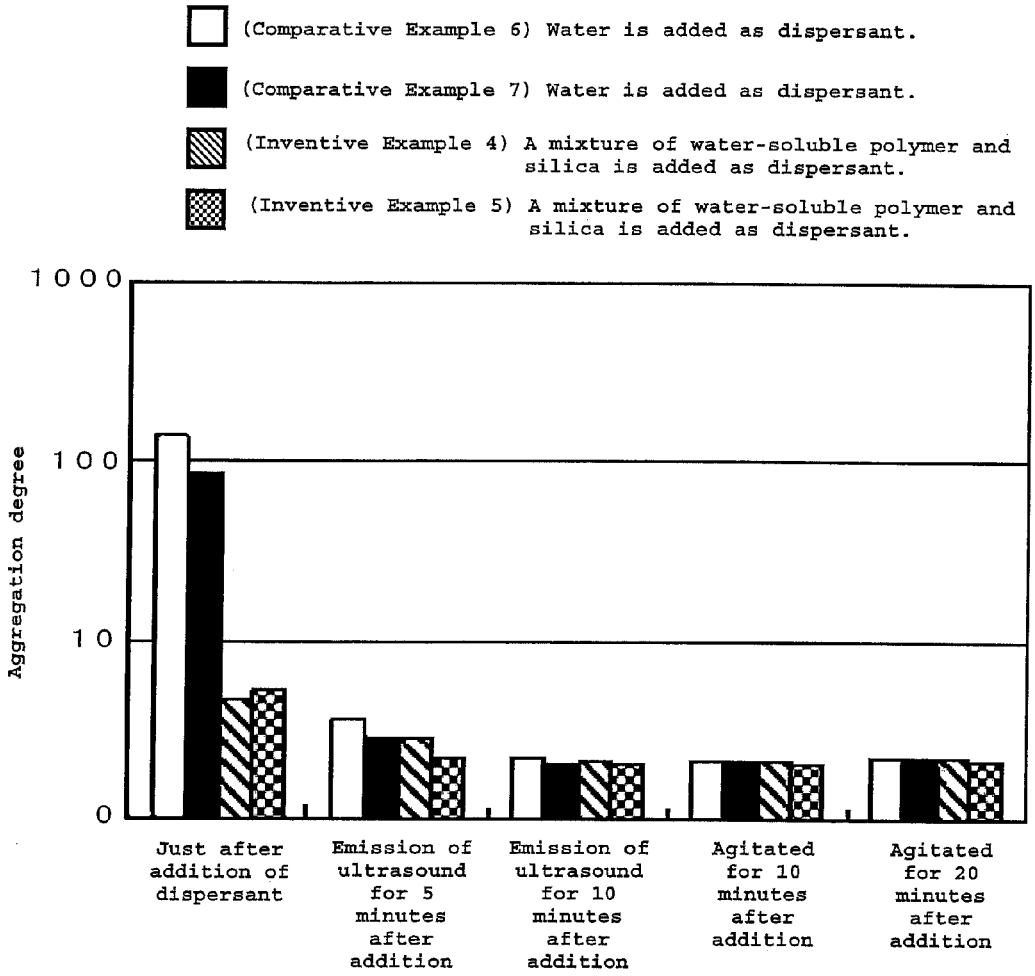
FIG. 8 is a graph showing the aggregates breakup effect when a slurry-constituent-containing chemical solution is used as dispersant.

FIG. 8 is a graph showing the effect for dispersion of aggregated silica when the slurry-constituent-containing chemical solution was used as the dispersant. As shown in FIG. 8, in case of just after addition of the dispersant, the aggregation degrees in Inventive Examples 4 and 5 were 1/10 or less, compared with Comparative Examples 6 and 7. In either case of 5 min ultrasonic emission after the addition, 10 min ultrasonic emission after the addition, 10 min agitation after the addition, or 20 min agitation after the addition, there is no big difference in aggregation degree among Comparative Examples 6 and 7 and Inventive Examples 4 and 5. Consequently, it could be confirmed that the mixture of water-soluble polymer and silica, being the slurry-constituent-containing chemical solution as dispersant, can inhibit aggregation of used slurry immediately after it is added.

These results reveal that in the recycling method and recycling apparatus of slurry for use in wafer polishing according to the present invention, aggregation of used slurry can be inhibited by effectively breaking up aggregated silica contained in the used slurry by the shearing force imparting device, and adding the dispersant to the used slurry.

According to the recycling method of slurry for use in wafer polishing of the present invention, the aggregation of used slurry can be inhibited by breaking up the aggregated silica contained in the used slurry by the shearing force imparting device, and adding the dispersant to the used slurry. Further, since the whole of used slurry is passed through the shearing force imparting device in the recycling method of slurry for use in wafer polishing of the present invention, a large amount of used slurry can be processed and recycled in a short time.

Further, in the recycling method of slurry for use in wafer polishing of the present invention, not only filter but also various foreign substances removing systems can be adopted in the foreign substances removing step to improve the foreign substances removal rate, since the aggregates in slurry can be surely broken up by the shearing force imparting device.

Consequently, if the recycling method and recycling apparatus of slurry for use in wafer polishing of the present invention are applied to the polishing process of semiconductor silicon wafer, production of high-quality semiconductor wafer can be stably performed since used slurry, from which foreign substances is surely removed, can be stably supplied to a wafer polishing machine.

What is claimed is:

1. A recycling method of slurry for use in wafer polishing for reusing the slurry used in a polishing process of semiconductor wafer, comprising the steps of:

using a recycling apparatus comprising a storage tank for storing a recovered used-slurry, a shear force imparting device and a foreign substance removing device, wherein the shear force imparting device and the foreign substance removing device are arranged in a sequence of the shear force imparting device and the foreign substance removing device along a pathway through which the used slurry is supplied from the storage tank to a wafer polishing machine;

adding a dispersant to a recovered used-slurry in the storage tank to inhibit aggregation of the slurry;

breaking up aggregates in such a manner that the whole of the used slurry, subjected to the dispersant addition step, is passed through the shearing force imparting device to impart shearing force to the aggregates contained in the slurry by the shearing force imparting device, thereby breaking up the aggregates; and removing foreign substances in the slurry subjected to the aggregate breakup step, by means of the foreign substances removing device.

2. The recycling method of slurry for use in wafer polishing according to claim 1, wherein a micro-bubble generator is used as the shearing force imparting device in the aggregate breakup step.

3. The recycling method of slurry for use in wafer polishing according to claim 2, wherein unused slurry is used as dispersant in the dispersant addition step.

4. The recycling method of slurry for use in wafer polishing according to claim 2, wherein any one of a cyclone micro-bubble generator, a horn micro-bubble generator and an extrusion micro-bubble generator is used as a micro-bubble generator.

5. The recycling method of slurry for use in wafer polishing slurry according to claim 4, wherein unused slurry is used as the dispersant in the dispersant addition step.

6. The recycling method of slurry for use in wafer polishing according to claim 1, wherein unused slurry is used as dispersant in the dispersant addition step.

* * * * *